US006564488B2

(12) United States Patent
Wittenberg

(10) Patent No.: US 6,564,488 B2
(45) Date of Patent: May 20, 2003

(54) SIGN DISPLAY ATTACHMENT SYSTEM

(76) Inventor: Ron Wittenberg, 17212 N. Scottsdale Rd., #2407, Scottsdale, AZ (US) 85255

( * ) Notice: Subject to any disclaimer, the term of this patent is extended or adjusted under 35 U.S.C. 154(b) by 4 days.

(21) Appl. No.: 09/888,993

(22) Filed: Jun. 25, 2001

(65) Prior Publication Data

US 2002/0194760 A1 Dec. 26, 2002

(51) Int. Cl.[7] ..... G09F 17/00; G09F 21/04
(52) U.S. Cl. ..... 40/603; 40/590
(58) Field of Search ..... 40/590, 603, 604, 40/790; 160/328, 371, 378

(56) References Cited

U.S. PATENT DOCUMENTS 5,042,182 A * 8/1991 King ..... 40/574
5,046,545 A * 9/1991 Loomis et al. ..... 160/328
5,685,099 A * 11/1997 Favata ..... 40/590
5,893,227 A * 4/1999 Johansson et al. ..... 160/328
6,209,245 B1 * 4/2001 Wittenberg ..... 160/378
6,250,002 B1 * 6/2001 Wittenberg ..... 160/378
6,276,082 B1 * 8/2001 Richards et al. ..... 160/327

* cited by examiner

*Primary Examiner*—Brian K. Green
(74) *Attorney, Agent, or Firm*—Frank J. McGue

(57) ABSTRACT

A signage display attachment system for mounting a sign to a substrate is disclosed. The signage display attachment system comprises a frame having a pair of vertical sides and a pair of horizontal sides. Each pair comprises a pair of base plates mounted to a substrate and a corresponding pair of tensioning plates having a plurality of recesses thereon. Each of the plurality of recesses is an elongated rounded trench shape. Further, each of the tensioning plates is adapted to mount to the pair of base plates. A securing device is adapted to releaseably hold the tensioning plate to the base plate. An insertion bead mounted to the edge of a sign is adapted to engage one of the plurality of recesses.

14 Claims, 6 Drawing Sheets

SIGN DISPLAY ATTACHMENT SYSTEM

BACKGROUND OF THE INVENTION

This invention relates to an attachment system or process for mounting flexible, easily replaceable advertising displays on to the side of a vehicle, such as a truck, tractor trailer, or van or fixed billboards or signs of various sizes.

There have been developed a number of methods for displaying advertising signage on the side of moving vehicles. Given the increased mobility of the public, and the growing unsatisfied demand for fixed roadside signage, the mobile billboard, achieved by mounting advertising art to the side of a transport vehicle, is becoming ever more common, and ever more practical, given advances in the technology of printing such advertising art, allowing better color quality, as well as much greater pixel resolutions. Taken together, these factors now make mobile, lateral surface of transport vehicle, advertising a higher quality and more sought after mode of commercial publicity than ever before. With the development of the science of mobile commercial publicity production, one would expect a corresponding development and sophistication in the technology of mounting said media to their substrate, the lateral sides of transport vehicles. This invention is a new step in said development and sophistication.

There are a number of constraining factors in designing a mobile advertising mounting system, some regulatory, others aesthetic, some physical. First, there exist federal as well as state transportation regulations restricting the width of transport vehicles to an upper limit of 102 inches. Secondly, transport advertising is most often procured by leasing the use of a carrier's fleet for such purpose. The fleet owner is inclined to lease to the advertising broker whose system impacts the lest on the fleet's vehicles, in terms of time required for initial setup of the system, turnaround time for installation/replacement of a particular image, and complexity of the permanent hardware attached to the vehicle.

Further, in order to maintain the planar aspect of the sign, which is critical to readability from afar, the current industry practice is to apply tension to the signage. The present invention is directed towards providing an improved method for applying said tension.

Tension has been applied in a variety of ways in the past. For example, in U.S. Pat. No. 5,239,765 tensioning is accomplished by wrapping the edges of the signage around a rectangular rod on the top and bottom edges and the wrapping is held in place by rows of anchors. The series of anchors method presents obvious difficulties as far as bringing the individual anchors within the top or bottom row into perfect linear alignment.

U.S. Pat. No. 5,507,109 uses shock cords attached to grommets and to a truck wall by means of S hooks connected to either flanges which run along the bottom and top edges of the sides of most trailers or by holes drilled in the sides of the trailer.

U.S. Pat. No. 6,209,245 entitled "Sign Display Attachment Method" which issued on Apr. 3, 2001 to the present inventor describes the use of a plurality of recesses on one side of a mounting plate with a pair of prongs on an insertion bead being receivable in combination within one of the plurality of recesses. Tension is controlled by selection of which of the plurality of recesses to employ.

Applicant's co-pending application No. 09/305,861 uses slots to tension the signage, the tension being maintained by screws/nuts secured through said signage and the slots and the truck or sign wall.

What is desired is a simpler, tool free method of tensioning signage mounted to a truck or a sign specially engineered to impact the truck or trailer at a minimum in terms of fasteners per foot required to the truck or trailer siding. Such a system should keep the signage material as planar as possible.

Further, such a system would have its framing removable, and insure protrusion from the lateral surface of the vehicle low enough to comply with all regulatory maximum vehicle width specifications.

The present invention meets these needs.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

Figure 1:
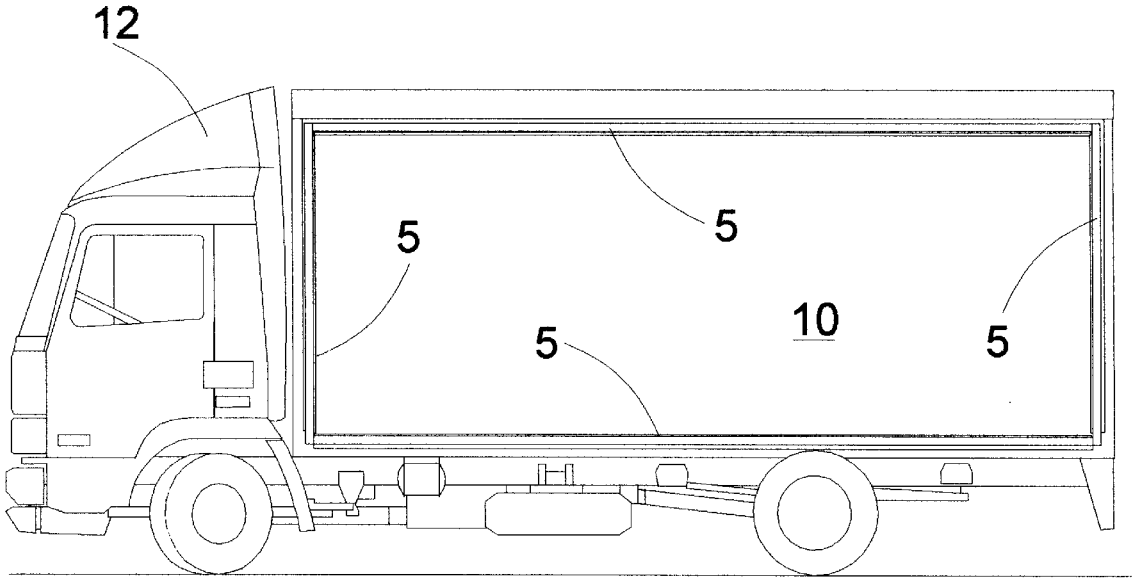
FIG. 1 provides a head-on view of the signage system fully installed and tensioned on the side of a truck.
Figure 2:
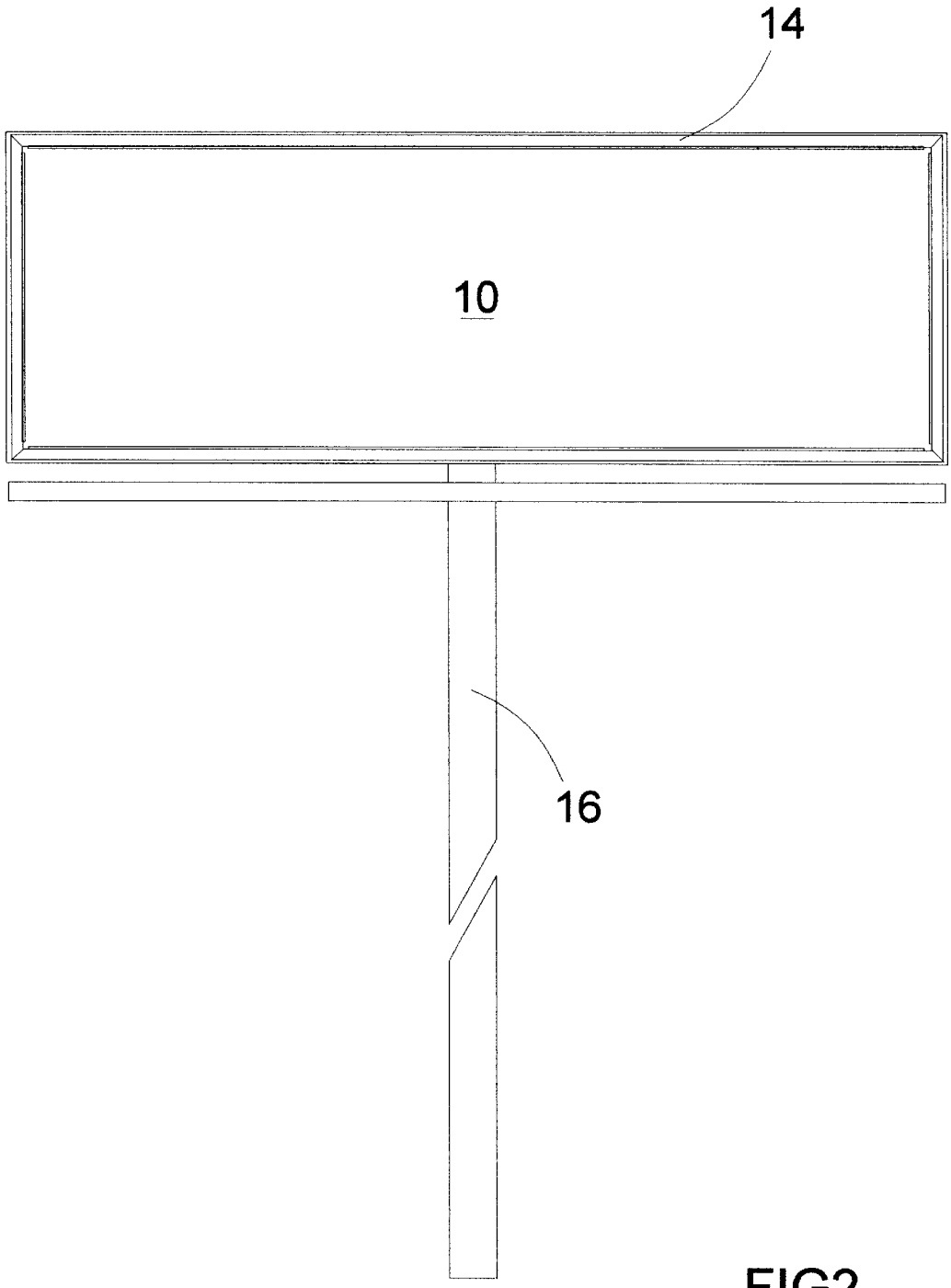
FIG. 2 is a head-on view of the signage system fully installed and tensioned on a fixed billboard.

Referring to FIG. 1, a typical embodiment of the signage display system of the present invention is shown. A flexible sign 10 is held in place on the side of a transport vehicle 12 by a frame 14. The system is shown in FIG. 2 in another embodiment as installed on a fixed billboard type sign. In this implementation, frame 14 is manufactured of high strength aluminum, in other implementations they can be made of materials with similar functional properties.

FIGS. 3–11 show corresponding detailed views of the present improved display attachment system to attach the edges of the sign. As best seen in FIGS. 3–6, frame 14 comprises a pair of vertical sides and a pair of horizontal sides, each pair comprising a pair of base plates 16 mounted to a substrate 18, a pair of tensioning plates 20 having a plurality of recesses 22 thereon mounted to base plates 16, a securing device adapted to releaseably hold the tensioning plate to the base plate, and an insertion bead 24 adapted to engage one of the plurality of recesses. For some dimensional reference, the width of mounting channel extending from the truck 12 is preferably less than ¼ inch thereby minimizing wind drag and width issues.

It will be apparent that in actual use, the two pairs of frames are employed for each sign, one pair for the vertical sides thereof and one for the horizontal sides thereof. However, the principles are the same for both pairs and the discussion below will be conducted accordingly.

Figure 4:
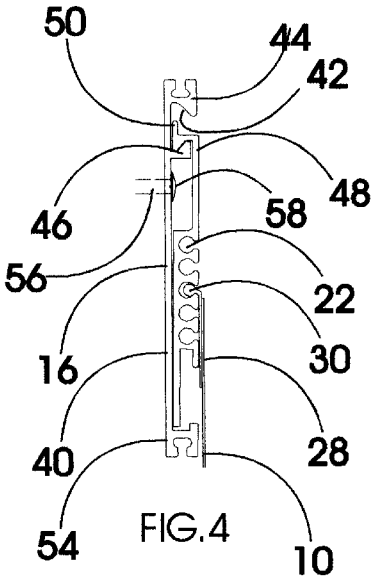
FIG. 4 is a cross sectional view taken along the section line 4—4 of FIG. 3.
Figure 6:
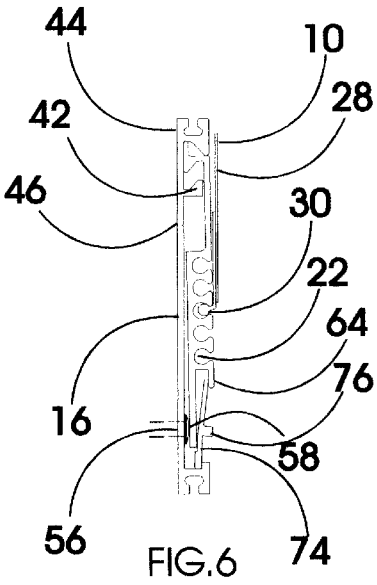
FIG. 6 shows a cross sectional view of the tensioning plate mounted to the base plate taken along line 6—6 of FIG. 5.
Figure 5:
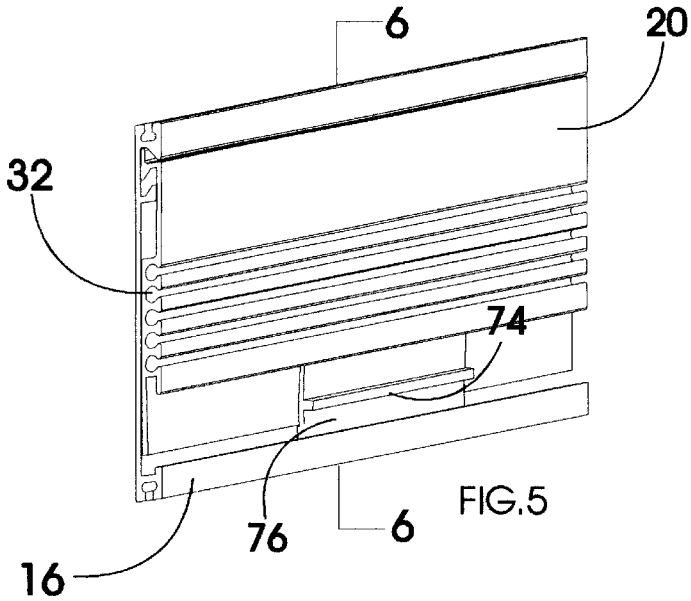
FIG. 5 shows a top view of a tensioning plate mounted on the base plate of FIG. 3.
Figure 8:
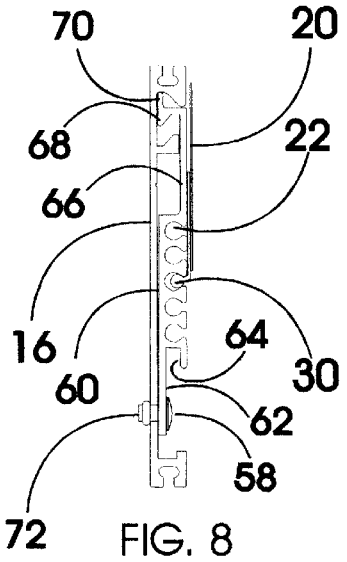
FIG. 8 is a cross sectional view taken along line 8—8 of FIG. 7.
Figure 7:
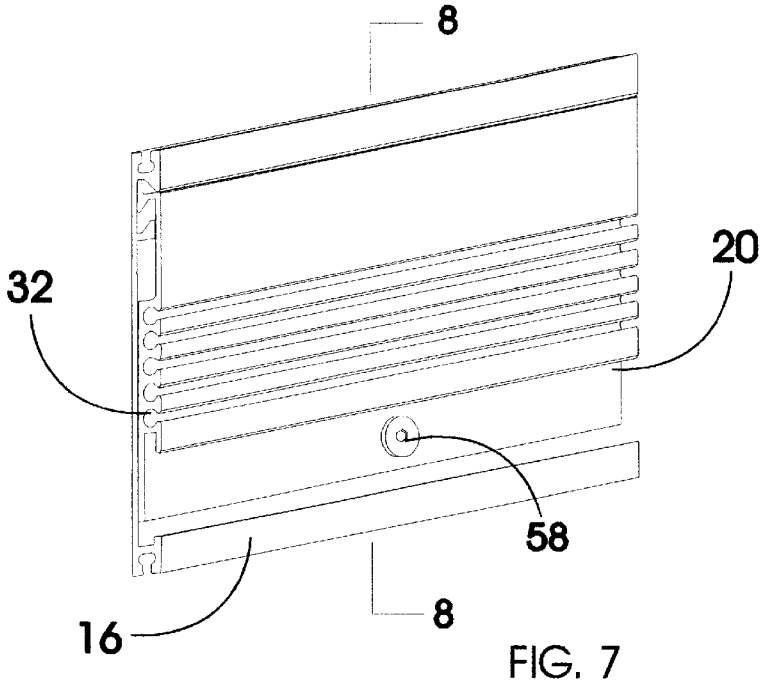
FIG. 7 is a top and side perspective view of one half of an assembled mount showing one embodiment of attaching to a substrate.

Insertion bead 24 has an elongated leg 28 which extend tangentially from a base 30. Elongated leg 28 is affixed to one edge of sign 10 as best seen in FIGS. 4, 6 and 8. In the presently preferred embodiment, insertion bead 24 is an elongated cylindrical shape which corresponds to the elongated rounded trench shape of each of the plurality of recesses 22. Base 30 of insertion bead 24 is inserted into one open end 32 of one of the plurality of recesses 22 and then slid into recess 22. Those skilled in the art will recognize that other shapes and techniques may be employed to secure an insertion bead to a recess.

Figure 3:
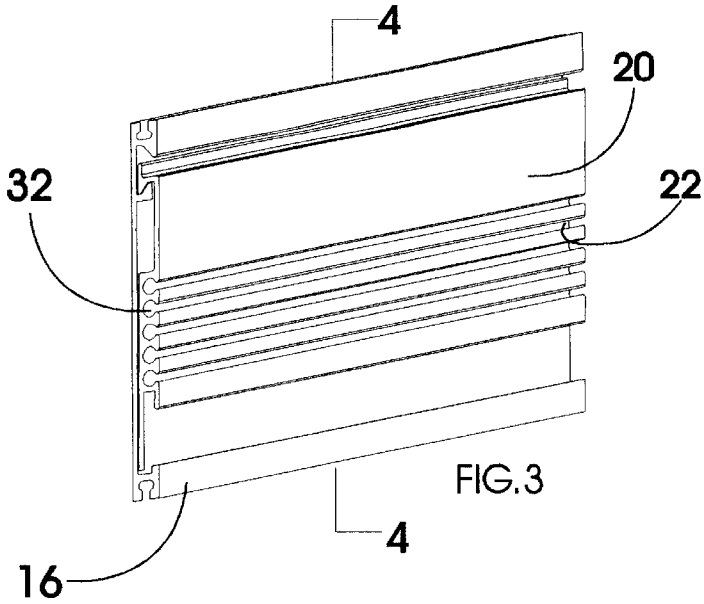
FIG. 3 shows a top and side perspective view of a tensioning plate mounted on a base plate mounted to a substate.

As best seen in FIGS. 3 and 4, base plate 16 comprises a flat rectangular base 40 having a trench 42 formed of sidewalls 44, 46 extending along one side of base 40. Trench 42 has an open top 48 which is narrower than a bottom 50 of trench 42. Both sidewalls 44 and 46 extend upwardly and inwardly from bottom 50 to form the narrower open top 48. Inner sidewall 46 is somewhat shorter than outer sidewall 44.

A T-shaped member 54 extends upwardly from base 40 along the edge thereof opposite trench 42.

To mount base plate 16 to substrate 18, holes 56 are provided, each hole 56 being adapted to engage a rivet 58. Holes 56 may be employed on the each one of the pair of base plates 16 used. On one of the pair, holes 56 are positioned proximate to T-shaped member 54 while on the other of the pair, holes 56 are positioned proximate to trench 42. While the presently preferred embodiment utilizes rivets 58, those skilled in the art will recognize that many other attachment devices are applicable to the present invention.

As best seen in FIGS. 4, 6 and 8, tensioning plate 20 comprises a flat back 60 having the plurality of recesses 22 extending upwardly from one side thereof and a flat open portion 62 on the other side thereof. An overhang 64 partially occludes that section of flat open portion 62 abutting the plurality of recesses 22.

Extending from the upper edge of the plurality of recesses 22 opposite flat open portion 62 and parallel thereto is a second flat portion 66. Extending downwardly from flat portion 66 is leg 68 having a base portion 70 opposite flat portion 66. Base portion 70 is narrow enough to enter into open top 48 of trench 42. Leg 68 and base portion 70 extend downwardly and outwardly into trench 42 and are adapted to firmly engage inner sidewall 46 when force is exerted by sign 10 as best seen the base plate 16 and tensioning plate 20 combination found on left side of FIGS. 9–11.

Figure 10:
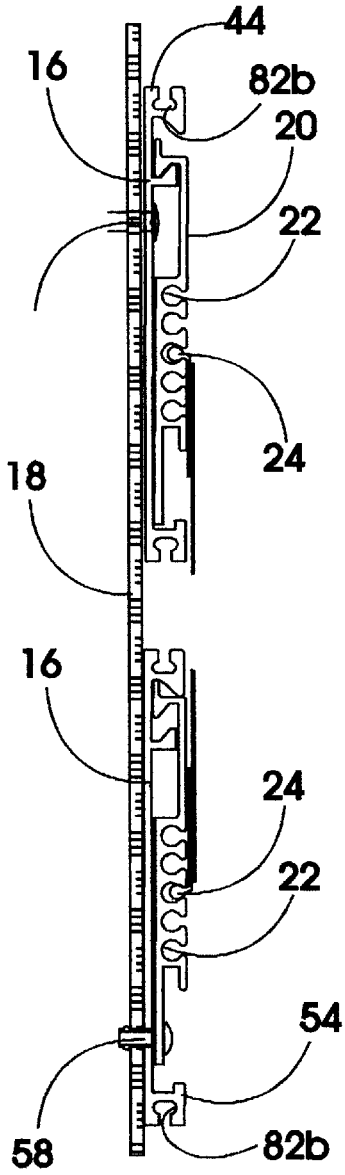
FIG. 10 shows one embodiment of securing the sign to the substrate.
Figure 11:
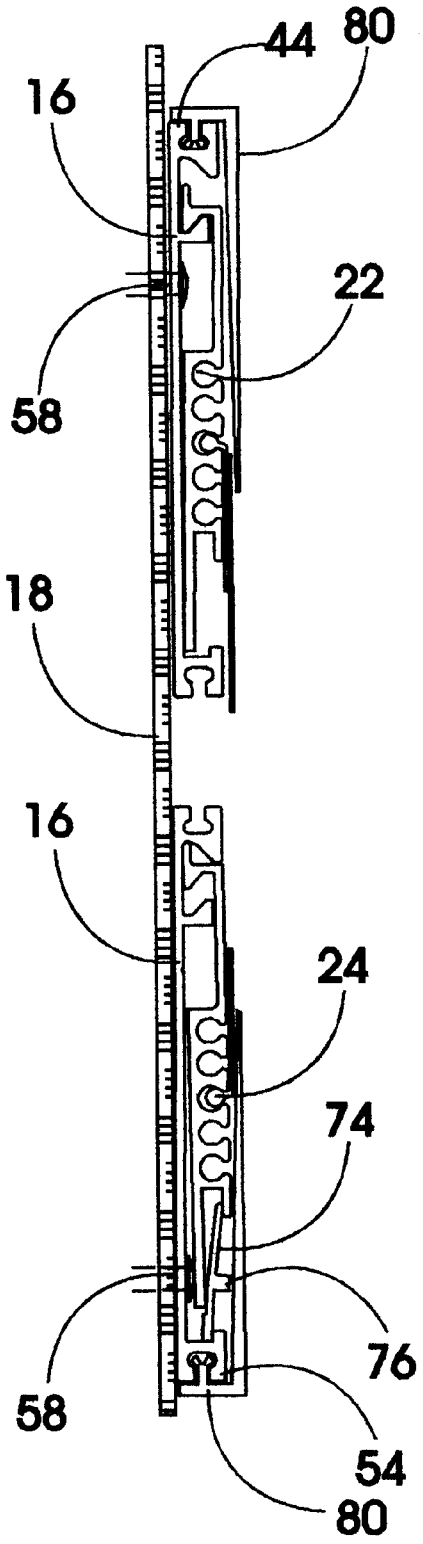
FIG. 11 shows another embodiment of securing the sign to the substrate.

Turning now to FIGS. 10–11, specifically, the other of the pair found on the right side thereof illustrate two methods of securing tensioning plate 20 to base plate 18 when the force exerted by sign 10 pushes leg 68 and base portion 70 into contact with outer sidewall 44 which is not a firm engagement.

As shown in FIGS. 8 and 10, an additional hole 72 is drilled through tensioning plate 20 to align with at least one hole 56 in base plate 16 whereby threading rivet 58 through both holes 72 and 56 secures tensioning plate 20 firmly to base plate 16.

Figure 9:
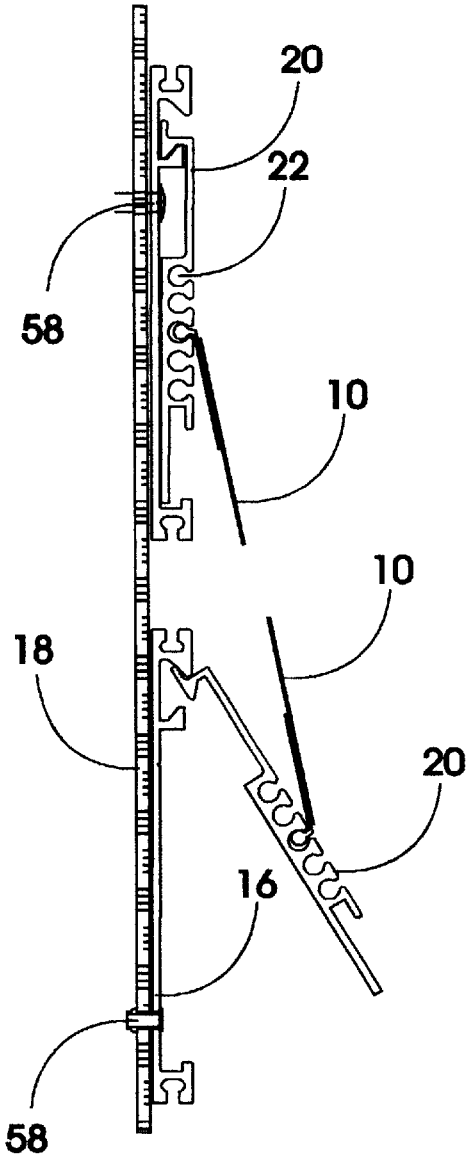
FIG. 9 shows a cross sectional view of a sign being installed onto a substrate.

In FIGS. 9, 10 and 11, a lock plate 74 having a handle 76 is employed to hold said tensioning plate 20 to base plate 16. Lock plate 74 is wide enough to extend from the leg of T-shaped member 54 to engage the underside of overhang 64. As best illustrated in FIG. 9, the torque exerted by the tension on sign 10 acts to strongly pull flat open portion 62 of tensioning plate 20 upwardly from base plate 16. As shown in FIG. 11, lock plate 74 prevents such movement and secures tensioning plate 20 to base plate 16.

To remove, a user depresses tensioning plate 20 proximate to lock plate 74 and, employing handle 76, moves lock plate 74 forwardly until disengagement of same from T-shaped member 54 allows easy removal of same. A shoulder 78 on the underside of lock plate 74 prevents such movement from occurring accidently.

An alternate embodiment is shown in FIG. 11 employing covers 80 which are adapted to engage slots 82*a* and 82*b* in outer sidewall 44 and T-shaped member 54, respectively. Covers 80 extend outwardly from substrate 18 along the outside of outer sidewall 44 and T-shaped member 54, then inwardly parallel to substrate 18 to cover insertion bead 24. Covers 80 are useful both for aesthetical purposes as well as to provide additional protection to the invention.

Although only certain embodiments have been illustrated and described, it will be apparent to those skilled in the art that various changes and modifications can be made therein without departing from the spirit of the invention or from the scope of the appended claims.

That which is claimed is:

1. A signage display attachment system for mounting a sign to a substrate, the signage display attachment system comprising a frame having a pair of vertical sides and a pair of horizontal sides, each pair of sides comprising a pair of base plates mounted to a substrate, a corresponding pair of tensioning plates each having a plurality of recesses thereon, the corresponding pair of tensioning plates being adapted to mount to the pair of base plates, a securing device adapted to releaseably hold each of the corresponding pair of tensioning plates to each of the pair of base plates, and an insertion bead mounted to the edge of a sign adapted to engage one of the plurality of recesses, the insertion bead having an elongated leg which extends tangentially from a base, the elongated leg being affixed to one edge of the sign.

2. The signage display system of claim 1 wherein the base is an elongated cylindrical shape which corresponds to the elongated trench shape.

3. The signage display system of claim 2 wherein the base is adapted to be inserted into an open end of one of the plurality of recesses and slidably received into the one of the plurality of recesses.

4. The signage display system of claim 1 wherein each of the corresponding pairs of base plates comprises a flat rectangular base having a trench formed of two sidewalls extending along a horizontal side of the flat rectangular base, the trench having an open top which is narrower than a bottom of the trench, the two sidewalls extending upwardly and inwardly from the bottom to form the narrower open top, one of the two sidewalls furthest from the horizontal side of the flat rectangular base being shorter than the other of the two sidewalls.

5. The signage display system of claim 4 wherein the base plate further comprises a T-shaped member extending upwardly from the flat rectangular base along the edge thereof opposite the trench.

6. The signage display system of claim 5 wherein the tensioning plate comprises a flat back having the plurality recesses extending upwardly from one side thereof and a flat open portion on the other side thereof, the tensioning plate further having an overhang extending over that section of the flat open portion abutting the plurality of recesses.

7. The signage display system of claim 6 wherein the tensioning plate further comprises a second flat back portion extending from the upper edge of the plurality of recesses opposite the flat open portion and parallel thereto, a leg having a base portion extending downwardly from the flat open portion opposite thereto, the base portion being narrow enough to enter into the open top of the trench, the leg and the base portion extending downwardly and outwardly into the trench and adapted to firmly engage the one of the two sidewalls.

8. The signage display system of claim 6 wherein the securing device comprises a lock plate, the lock plate being wide enough to extend from the T-shaped member to engage the overhang wherein torque exerted by the tension on the sign acts to strongly pull the flat open portion of the tensioning plate upwardly from the base plate, the lock plate preventing such movement and securing the tensioning plate to the base plate.

9. The signage display system of claim 1 wherein the base plate is mounted to a substrate via rivets and corresponding holes in the base plate.

10. The signage display system of claim 1 wherein the securing device comprises an additional hole drilled through the tensioning plate which aligns with a hole in the base plate whereby threading a rivet through both of the holes secures the tensioning plate firmly to the base plate.

11. A signage display attachment system for mounting a sign to a substrate, the signage display attachment system comprising a frame having a pair of vertical sides and a pair of horizontal sides, each pair of sides comprising a pair of base plates mounted to a substrate, each base plate comprising a flat rectangular base having a trench formed of two sidewalls extending along a horizontal side of the flat rectangular base, the trench having an open top which is narrower than a bottom of the trench, the two sidewalls extending upwardly and inwardly from the bottom to form the narrower open top, one of the two sidewalls furthest from the horizontal side of the flat rectangular base being shorter than the other of the two sidewalls, the base plate further having a T-shaped member extending upwardly from the flat rectangular base along the edge thereof opposite the trench, a corresponding pair of tensioning plates each having a plurality of recesses thereon, the corresponding pair of tensioning plates being adapted to mount to the pair of base plates, each of the tensioning plates comprising a flat back having the plurality of recesses extending upwardly from one side thereof and a flat open portion on the other side thereof, the tensioning plate further having an overhang extending over that section of the flat open portion abutting the plurality of recesses, the tensioning plate further comprising a second flat back portion extending from the upper edge of the plurality of recesses opposite the flat open portion and parallel thereto, a leg having a base portion extending downwardly from the flat portion opposite thereto, the base portion being narrow enough to enter into the open top of the trench, the leg and the base portion extending downwardly and outwardly into the trench and adapted to firmly engage the one of the two sidewalls, a securing device adapted to releaseably hold the tensioning plate to the base plate, and an insertion bead mounted to the edge of a sign adapted to engage one of the plurality of recesses, the insertion bead having an elongated leg which extends tangentially from a base, the elongated leg being affixed to one edge of the sign, the base being an elongated cylindrical shape which corresponds to the trench, the base being adapted to be inserted into an open end of one of the plurality of recesses and slidably received into the one of the plurality of recesses.

12. The signage display system of claim 11 wherein the securing device comprises a lock plate, the lock plate being wide enough to extend from the T-shaped member to engage the overhang wherein torque exerted by the tension on the sign act to strongly pull the flat open portion of the tensioning plate upwardly from the base plate, the lock plate preventing such movement and securing the tensioning plate to the base plate.

13. The signage display system of claim 11 wherein the base plate is mounted to a substrate via rivets and corresponding holes in the base plate.

14. The signage display system of claim 11 wherein the securing device comprises an additional hole drilled through the tensioning plate which aligns with a hole in the base plate whereby threading a rivet through both of the holes secures the tensioning plate firmly to the base plate.

* * * * *